US007954678B2

(12) United States Patent
Regan et al.

(10) Patent No.: US 7,954,678 B2
(45) Date of Patent: Jun. 7, 2011

(54) PRESSURE CONTROL DEVICE FOR A FLUID DISPENSING CONTAINER

(75) Inventors: Phil Regan, Drunen (NL); Roy Van Swieten, Hedel (NL); Niels Van Wieringen, Hertogenbosch (NL)

(73) Assignee: I.P.S. Research and Development B.V., Vlijmen (NL)

( * ) Notice: Subject to any disclaimer, the term of this patent is extended or adjusted under 35 U.S.C. 154(b) by 768 days.

(21) Appl. No.: 11/997,201

(22) PCT Filed: Aug. 1, 2005

(86) PCT No.: PCT/IB2005/052571

§ 371 (c)(1),
(2), (4) Date: Feb. 29, 2008

(87) PCT Pub. No.: WO2007/015123

PCT Pub. Date: Feb. 8, 2007

(65) Prior Publication Data

US 2008/0217571 A1 Sep. 11, 2008

(51) Int. Cl.
*B67D 7/60* (2010.01)

(52) U.S. Cl. ..... 222/389; 222/399

(58) Field of Classification Search ..... 251/144; 222/389, 399; 137/529

See application file for complete search history.

(56) References Cited

U.S. PATENT DOCUMENTS

| | | | | |
|---|---|---|---|---|
| 4,456,155 | A * | 6/1984 | Miyata et al. | 222/396 |
| 5,215,217 | A * | 6/1993 | Leslie | 222/5 |
| 6,616,017 | B2 * | 9/2003 | van 't Hoff | 222/389 |
| 7,708,171 | B2 * | 5/2010 | Regan et al. | 222/389 |
| 7,748,578 | B2 * | 7/2010 | van't Hoff | 222/389 |
| 2003/0019888 | A1 | 1/2003 | Gupta | |

FOREIGN PATENT DOCUMENTS

| | | | |
|---|---|---|---|
| EP | 0 349 053 | A1 | 1/1990 |
| WO | 9322222 | A1 | 11/1993 |
| WO | 9962791 | A1 | 12/1999 |
| WO | 2004065217 | A2 | 8/2004 |
| WO | 2004065260 | A1 | 8/2004 |
| WO | 2005082744 | A1 | 9/2005 |

OTHER PUBLICATIONS

International Seach Report for International Application No. PCT/IB2005/052571 filed Aug. 1, 2005 (3 pages).

Written Opinion of the International Searching Authority for International Application No. PCT/IB2005/052571 filed Aug. 1, 2005 (7 pages).

* cited by examiner

*Primary Examiner* — John K Fristoe, Jr.

(74) *Attorney, Agent, or Firm* — McCormick, Paulding & Huber LLP

(57) ABSTRACT

A novel pressure control device is provided comprising a first cylinder (3) at a predetermined excess pressure, a piston (4) with a sealing ring (5) being movable within said first cylinder, and a second cylinder (7). The first cylinder (3) is encompassed by the second cylinder (7) as to form a ring-shaped passage which is leading to the outside. A valve in said passageway is released and closed by a stem (14) of the piston (4). The open end of the first cylinder (3) is provided with at least one axially directed incision (37), such that the piston (4) with the sealing ring (5) introduced in the first cylinder (3) and covering the end of the incision (37) is in a non-pressurized position. The stem (14) has a stop element (15) which closes the valve in the upper position of the piston, wherein the piston stroke essentially defines the excess pressure.

12 Claims, 4 Drawing Sheets

16

12

2

6

PRESSURE CONTROL DEVICE FOR A FLUID DISPENSING CONTAINER

CROSS REFERENCE TO RELATED APPLICATIONS

This application is entitled to the benefit of and incorporates by reference essential subject matter disclosed in International Patent Application No. PCT/IB2005/052571 filed on Aug. 1, 2005.

FIELD OF THE INVENTION

The present invention concerns a pressure control device for a fluid dispensing container for maintaining a constant predetermined excess pressure and a method for manufacturing such a pressure control device.

BACKGROUND OF THE INVENTION

Containers with pressure control devices are known in patent literature since almost thirty years but until today no commercial products are available on the market.

In EP-A-0 349 053 a pressure capsule for a spray can is described, which consists of two chambers. The first chamber is filled with a fluid under relatively high pressure and the second chamber is filled with a fluid with a pressure equal to the overpressure which normally exists in the spray can and needed for expelling a liquid. In the wall of the second chamber a membrane controls a valve. A plug in the wall keeps the fluid under pressure so that the valve keeps closed.

In WO-A-93/22222 (Cruysberghs) published in 1993 a pressure control device for maintaining a constant pressure in a container is disclosed in principle. Many different embodiments of the device are described, but in practice none was realized in commercial scale.

Another example of such a pressure control device is known from PCT patent application WO-A-99/62791. The device described therein is provided for maintaining a constant predetermined pressure in a container which is arranged for dispensing a fluid. The pressure control device has a first chamber and a second chamber, as well as a closing member movable relative to the second chamber for releasing and closing a fluid connection between the first chamber and the container depending on the position of the closing member relative to the second chamber. The first chamber is filled with a gas which, in use, has a higher pressure than the pressure in the container. The second chamber is closed having a gas at a predetermined or reference pressure and is located outside the first chamber. In a first embodiment according to FIG. 2 of WO-A-99/62791, the first chamber is provided as a cup-shaped holder which is placed upside down in the container and has its longitudinal edge joined together with the bottom and the upright sidewall of the vessel or container. In FIG. 3*a* second embodiment is shown in which the diameter of cup-like first chamber is much smaller than the inner diameter of the container. The chamber is centrally disposed within the container and joined at its longitudinal edge with the bottom of the container. In FIG. 4*a* third embodiment is shown in which the same first chamber as in FIG. 3 is disposed eccentrically with respect to the container. In FIG. 5*a* disc is provided slightly below the middle of the height of the vessel and is gas-tightly connected with the inner wall of the vessel through a sealing ring. This disc divides the vessel into two (fixed arranged) parts. A similar construction is shown in FIGS. 6*a* and 6*b*. Further, in FIG. 7 the first chamber of pressure control device is designed as a plunger which is sealed to the inner wall of the container with a sealing ring and which can be moved in axial direction within the container. Thus, the plunger divides the container in two parts, wherein the upper part is filled with the fluid to be dispensed. The fluid connection from the first chamber terminates in the lower part. When the pressure in the container drops since fluid has been dispensed by the push button on top of the container, the plunger is moved upwards because of the pressure difference between the lower and the upper part until pressure equilibrium between the lower and the upper part is obtained again. Therefore, the pressure in the lower part has decreased so that the pressure in the second chamber will be higher and the closing member will open the fluid connection between the first chamber and the lower part, so that the pressure in the lower part will rise. The plunger will then be moved upwards again until a pressure equilibrium is achieved corresponding to the predetermined or reference pressure in the second chamber. Finally, in the embodiment according to FIG. 8 the first chamber is of cylindrical design and has an outer diameter corresponding to the inner diameter of the container and thus fitted tightly within the container.

Only the pressure device of FIG. 7 of WO-A-99/62791 is movable in an axial direction. In all other examples the pressure device is fixedly arranged within the container. The complete pressure control device of FIG. 7 is designed as a plunger which functions as a movable piston expelling the dispensing fluid. However, the design of the pressure control device is disadvantageous because of its large dimensions so that less of the container can be used for dispensing fluid.

A further important problem of the above described pressure control devices as a separate module is that the first and second chambers have to be pressurized before mounting in a container. This in practice may be very difficult and costly to achieve e.g. in aluminium aerosol cans where the construction is in one-piece and the production lines run at very high outputs. A further major disadvantage is that it has been shown that the pressure in a separate pressure control device which will be mounted afterwards in a container drops to a large extent during a period of some months which is necessary for storage and distribution in the commercial supply chain. In addition, pressurizing of the pressure control device has to be performed with the fluid connection closed in order to obtain a pressure of the prescribed quantity. Thus the known pressure control devices are not suitable for application in a large industrial scale.

It is therefore an object of the present invention to provide a pressure control device for a fluid dispensing container which is simpler in construction. Another object of the invention is to provide a manufacturing process of the pressure control device which may be assembled easily in a fluid dispensing container.

SUMMARY OF THE INVENTION

A main advantage of the present invention is that the pressure control device can be pressurized after implementation and filling of the liquid dispensing bottle. This means that the pressure control device may be pressurized at the same time as the bottle of fluid container is filled. Thus there is no need to pressurize the device in advance as was necessary with previous pressure control devices as e.g. described above. Since the second chamber is encompassing the first chamber, a very compact pressure control device will be obtained so that the total usable space in the bottle is much larger as in known embodiments. As the pressure control device can be fabricated in advance and can be implemented easily in existing plastic bottles, the existing production and filling procedures for e.g. cosmetic products can be maintained with only little additional arrangements in the production line.

Further advantages of the invention are disclosed in the dependent claims and in the following description in which an exemplified embodiment of the invention is described with respect to the accompanying drawings. It shows

DETAILED DESCRIPTION OF THE INVENTION

Specific numbers dedicated to elements defined with respect to a particular figure will be used consistently in all figures if not mentioned otherwise.

Figure 1:
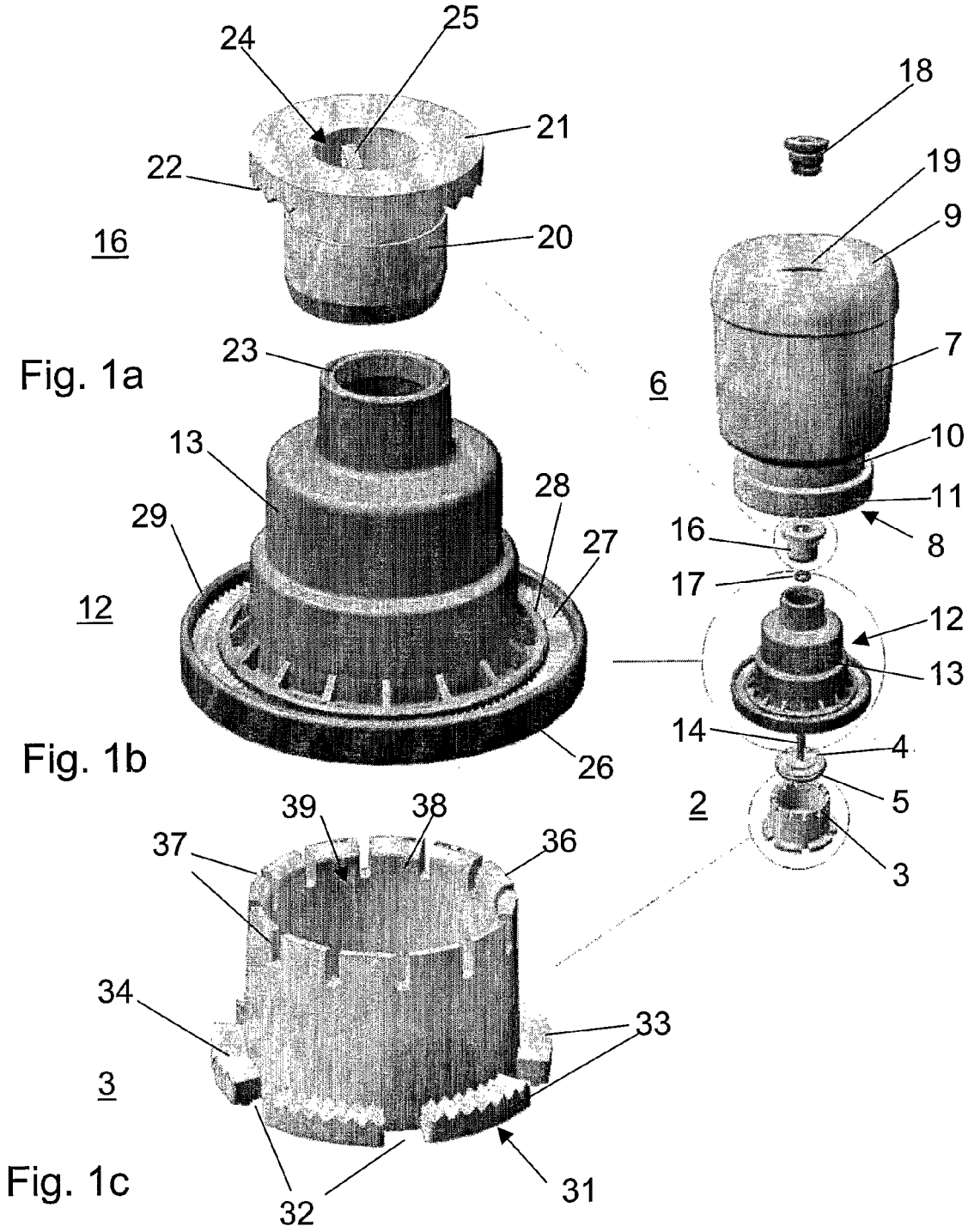
FIG. 1 illustrates a pressure control device of the present invention in a perspective, exploded and bottom view, wherein some parts are shown at a larger scale.
Figure 2:
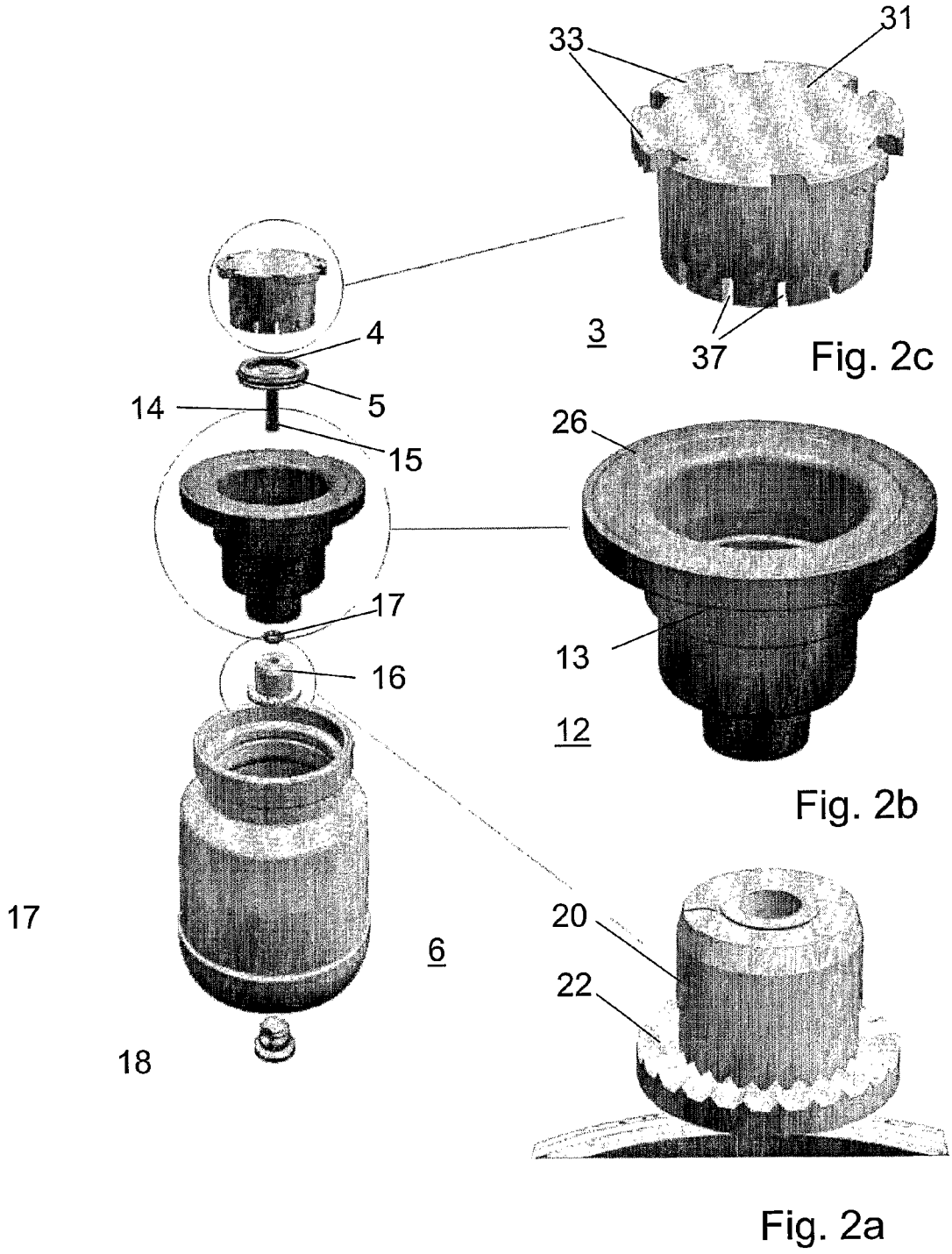
FIG. 2 illustrates the pressure control device of FIG. 1 in top view.

In FIGS. 1 and 2*a* pressure control device 1 for maintaining a constant predetermined excess pressure in a container is shown in perspective and in exploded view. The device 1 comprises a first chamber 2 provided by a first cylinder or cup-like insert 3 with a movable piston 4 with a large O-ring 5 and a second chamber 6 provided by a bottle-type second cylinder 7 with an open end 8 and a closed end 9. The open end 8 of the cylinder 7 has a tapered neck part 10 and a flange 11, on which a ring-shaped insert or closure 12 with a stepped funnel 13 is mounted, in which the cup-like insert 3 is fixed. The piston 4 has a stem 14 with an end part 15 of larger diameter (FIG. 2). A stop element 16 with an sealing O-ring 17 are mounted at the other end of the closure 12, which provides together with a valve seat in the closure a closing or regulating valve. At the bottom 9 of the cylinder 7 is mounted a sealing or Nicholson plug 18 in an opening 19 for pressurizing the cylinder 7.

In FIG. 1*a* the stop element 16 is shown in enlargement. It comprises a cylindrical part 20 and a larger ring part 21 with on the underside thereof serrated teeth 22 for ultrasonic welding on the lower rim 23 of the closure 12. In the inner circular hollow 24 of the stop element 16 three guiding ribs 25 distanced at an angle of 120° to each other are provided for guiding the piston stem 14. Further the piston stem 14 has two grooves parallel to the stem axis for venting the gas or air with high pressure over the regulating valve provided by the end part 15 of the stem 14 and the small O-ring 17. These grooves are extending up to the end part 15. In FIG. 1*b* the closure 12 is shown in enlargement. As can be seen a large rim part 26 is provided having a ring-shaped groove 27 with a ring of inner teeth 28 and a ring of outer teeth 29 for ultrasonic welding the closure 12 to the flange 11 of the cylinder 7. In FIG. 1*c* the cup-like insert 3 is shown in enlargement and showing a circular top plate 31 (see FIG. 2*c*) provided with six indents 32, regularly distributed over the rim, forming projections 33 with serrated teeth 34 underneath. Further at the open end 36 of the cylindrical cup 3 axially directed incisions 37 are provided. If assembled the piston 4 with the sealing ring 5 is just covering the ends of the incisions 37 in a pressure equilibrium, i.e. at the initial or non-pressurized position. Additionally, in direct vicinity of the open end of the insert 3 the inner wall 38 there may be provided an inner step 39 at the ends of the incisions 37, on which step 39 the piston 4 with its sealing O-ring 5 is laying in the initial or not-pressurized position (see below). For lowering the friction between the sealing O-ring 5 and the wall of the cup-like insert 3*a* friction reducing gel, e.g. of silicones or graphite oil, is used to cover the sealing ring 5.

In FIG. 2 and FIGS. 2*a*, 2*b* and 2*c* which are numbered commensurate to the elements shown in FIGS. 1*a*, 1*b* and 1*c*, the same pressure control device 1 as in FIG. 1 is depicted upside down.

Figure 3A:
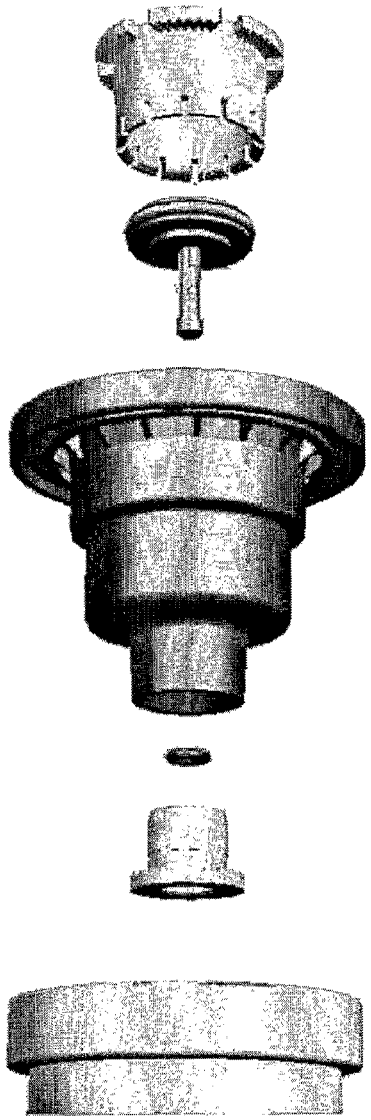
FIG. 3 illustrates an exploded view from the bottom and from the top for explanation of the assembling of the pressure control device.
Figure 3B:
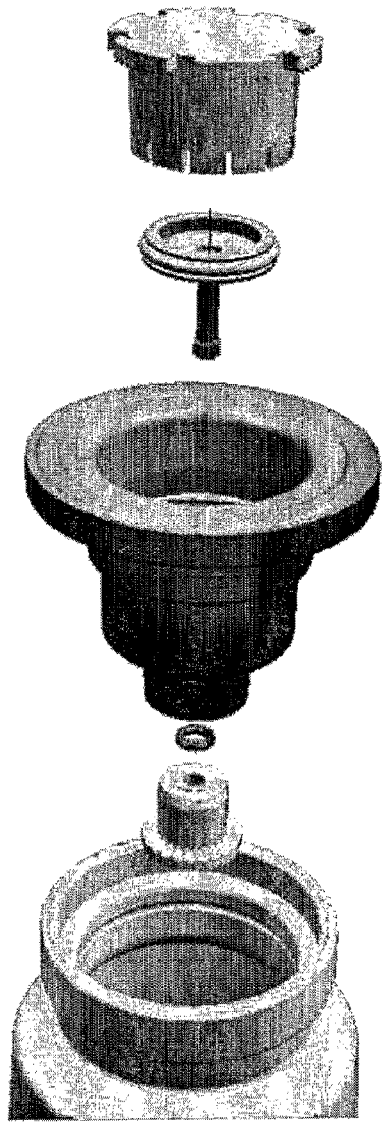

FIGS. 3*a* and 3*b* show the assembling positions of the different parts as described above.

Figure 4:
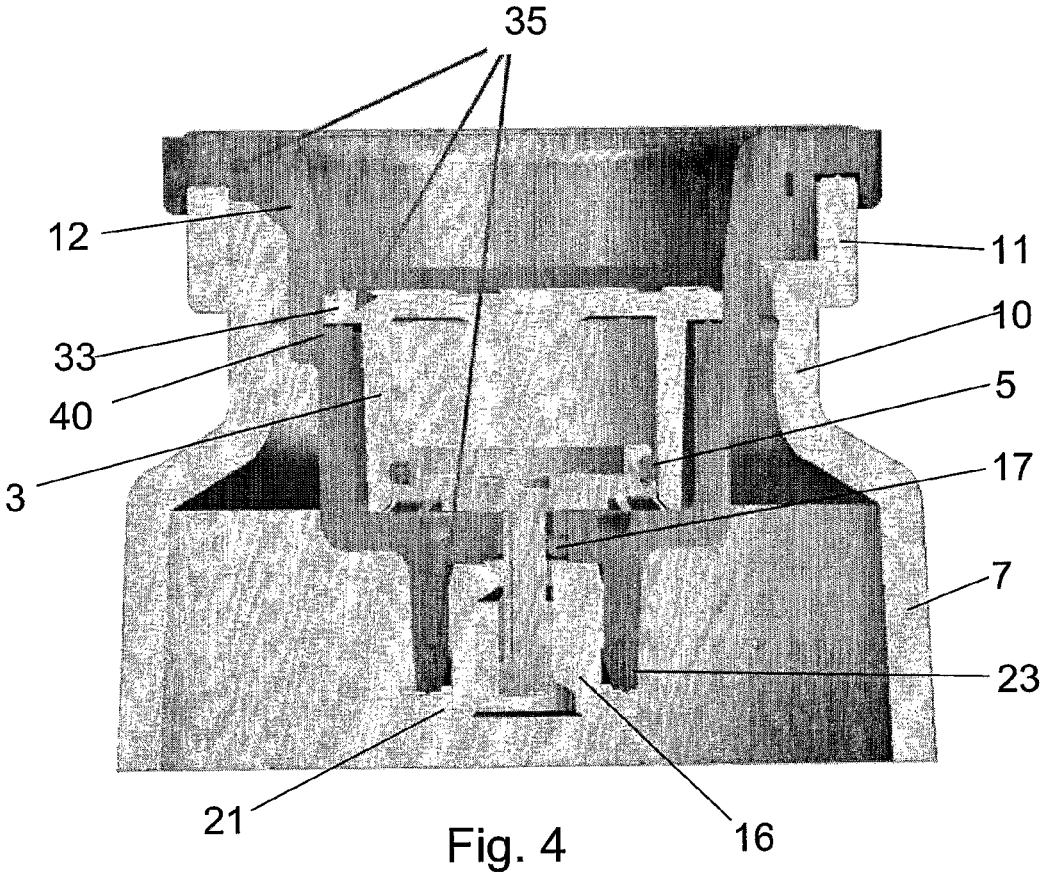
FIG. 4 illustrates a cross-section through a part of the assembled pressure control device in perspective view.
Figure 5:
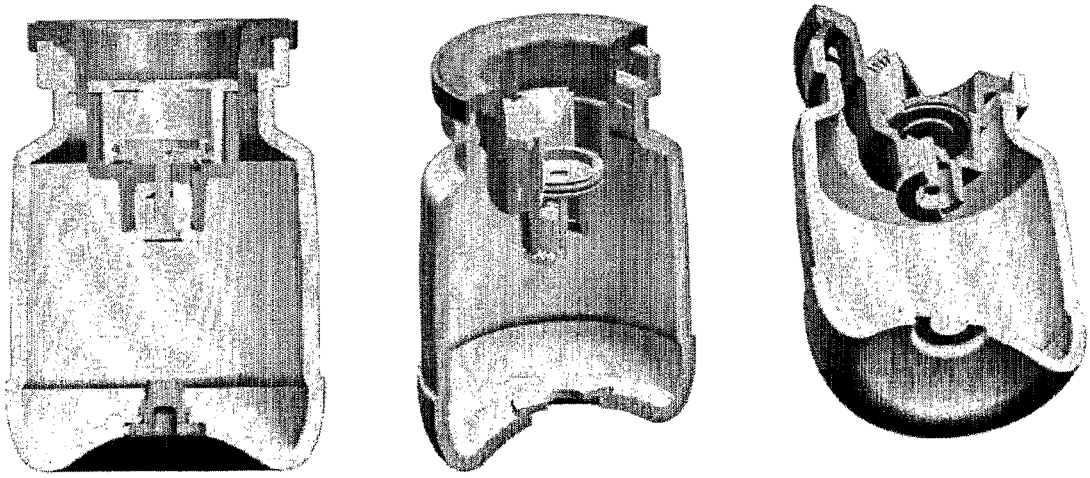
FIG. 5 illustrates three cross-sectional views of the assembled pressure control device.

In FIG. 4 partly a cross-section of the assembled pressure control device 1 is shown, whereas the arrows 35 direct to the welding areas between the closure 12 and the flange 11 of the second cylinder 7, between the projections 33 and an inner ring-step 40 of the funnel 13, and between the ring part 21 of the stop element 16 and the lower rim 23 of the closure 12.

Working

The function of the above described pressure control device 1 is as follows: in the second chamber 6 an inert gas, especially normal air, with an overpressure of approximately 8 bar is filled in. In the assembled position the first chamber 2 is at normal air pressure, wherein the sealing ring 5 of the piston 4 is just covering the ends of incisions 37 or is laying on the inner step 39, respectively. The force exerted on the stem 14 by the overpressure in the second chamber 6 pushes the piston towards the circular top plate 27 of the insert 3, until the valve between the stop element 16 and the sealing O-ring 17 will be closed. Since the pressure in the space above the piston 4 raises according to the Law of Boyle-Gay Lussac and the overall temperature will be constant, the pressure in the first chamber 2 will be proportional to the volume at the valve closing position and the volume at the initial position and normal pressure. Over the incisions 32 and the indents 28 of the insert 3 there is a passageway from the second chamber 6 over the valve to the outside, i.e. over the top plate 27 of the insert 3. The so assembled pressure control device 1 is mounted at the bottom of a fluid container with e.g. a spraying valve which is actuated by a knob. If the pressure in the container is equal to the control pressure in the first chamber 2 the regulating valve of the pressure control device 1 remains closed. However, if some of the fluid is dispensed over the spraying valve, the pressure in the container drops and the regulating valve will be opened, so that gas with overpressure will flow from the second chamber 6 to the container. As the pressure in the container will equalize quite fast to the control pressure the regulating valve will be closed again.

If a larger amount of fluid will be spent over the spraying valve, the regulating valve will oscillate between the open and closed positions. In practice the piston will be moved only some tenth or hundredth of millimeter by a rolling motion of the sealing O-ring 34 to open and close the valve.

Practical Calculations

Mathematical models of the pressure control device show that the control pressure obeys following equation:

$$P_c = \frac{-(P_R * V_2 * A_1 - P_l * V_1 * A_2)}{V_2 * (A_2 - A_1)}$$

wherein $P_C$=control or excess pressure, $P_R$=pressure in the second chamber, $P_I$=pressure in the initial position (normal air pressure)
$A_1$=area of the piston stem
$A_2$=area of the piston
$V_1$=volume in the first chamber above the piston in the initial position,
$V_2$=volume in the first chamber above the piston in the pressurized position, Thus, this equation allows to calculate the container pressure when the pressure in the second chamber 6 and the dimensions of the piston 4 and the piston stem 14 are determined. The equation further shows that the control pressure $P_C$ in the first chamber 2 slightly increases as the pressure in the second chamber $P_R$ decreases until the $P_R$ equals $P_C$, where the pressure control device 1 remains open. Thus, the equation also allows to determine the minimal pressure $P_R$ for dispensing all the fluid in the container.

At predetermined geometrical dimensions of the piston 4 and the piston stem 14 the volume $V_2$ is defining the control or excess pressure $P_C$. Thus, by amending only the thickness of the piston 4 different control pressures Pc can be provided at the same geometry of the cup-like insert 3.

Manufacturing Process

The cup-like insert 3 and the closure 12 are moulded from polyethylene terephthalate (PET). The piston 4 with piston stem 14 and the stop element 16 are moulded from polyoximethylene (POM). The bottle-like cylinder 7 is injection blow moulded from PET. The main advantages of the injection blow moulding process for producing the cylinder 7 is that different sizes can be produced with the same tool, and that the orientation of the stretched PET material during the blowing process leads to a higher crystalline structure which gives high strength and good gas barrier properties.

The assembling process is as follows: firstly piston 4 with its sealing O-ring is introduced into the cup-like insert 3. Then the insert 3 is pressed into the funnel 13 of the closure 12 until the projections 33 with its serrated teeth 34 are lying firmly to the ring step of the funnel 13. The insert 3 is then ultrasonic welded to the funnel 13. Thereafter the stop element 16 with the small sealing O-ring 17 are pushed over the piston stem 14 and the stop element 16 is clamped with a snap-fit connection to the funnel 13 and thus pinching the O-ring 17 between the funnel 13 and the upper side of the step element 16. Then the ring part 20 of the stop element 16 is ultrasonic welded to the lower rim of the funnel. At the end the closure 12 is mounted to the flange 11 of the cylinder 7 and ultrasonic welded thereto. The so assembled pressure control device 1 is ready for use to be mounted in a fluid dispensing container e.g. with a spraying nozzle. Thereinafter the cylinder 7 is pressurized with an inert gas or air with an overpressure of e.g. 8 bar, so that the piston 4 is moved upwards and the regulating valve provided by the piston stem 14 and the small O-ring 17 is closed and the container is pressurized with the predetermined excess pressure. Assembling may be done also in a somewhat different sequence, if required.

It is clear that the elements may be fixed also by other welding methods like rotation welding, laser welding or any other well-known plastics welding method, or by adhesives or mechanical fastening, e.g. snap-fit or screws.

A further advantage of the invention is that, since only normal air or any other suitable inert gas is used for the pressure filling, the process facilities, equipment and manufacturing environment and operating procedures do not need to take account of the special safety requirements normally needed for dangerous flammable propellants.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A Pressure control device provided for a fluid dispensing container comprising a first cylinder having an open end and a closed end, provided for being pressurized with a gas at a predetermined excess pressure, a piston with a sealing ring being movable within said first cylinder, a second cylinder with a closed end and an open end, provided for being filled with a gas at a pressure higher than the excess pressure, the first cylinder being encompassed by the second cylinder as to form a ring-shaped passage between the first and second cylinder, whereby the open end of the second cylinder arranged adjacent to the open end of the first cylinder, a passageway leading from the inside of the second cylinder past the outer wall of the first cylinder to the outside; a valve for releasing and closing said passageway, wherein said piston comprises a stem for opening and closing the valve, characterized in that the open end of the first cylinder is provided with at least one axially directed incision, such that the piston with the sealing ring introduced in the first cylinder and covering the end of the incision is in a non-pressurized position, and the stem having a stop element which closes the valve in the upper position of the piston, wherein the length of the stem is defined to determine the stroke of the piston between the non-pressurized position and the valve closing position, which piston stroke in conjunction with the inner volume of the piston space at the valve closing position defines the predetermined excess pressure.

2. The pressure control device as claimed in claim 1, wherein the first cylinder has an inner step provided at the end of the at least one incision, on which step the piston with the sealing ring is laying in the non-pressurized position.

3. The pressure control device as claimed in claim 1, wherein the outer contour of the piston is smaller than the inner diameter of the first cylinder, such that the sealing ring only contacts the inner wall of the first cylinder.

4. The pressure control device as claimed in claim 3, wherein the sealing ring is provided with a friction reducing gel.

5. The pressure control device as claimed in claim 4, wherein the friction reducing gel comprises silicones or graphite oil.

6. The pressure control device as claimed in claim 1, wherein the second cylinder is closed by a funnel-formed closure in which a cylindrical cup as first cylinder is mounted.

7. The pressure control device as claimed in claim 5, wherein the funnel-formed closure is fixed by a weld to the second cylinder, and the cylindrical cup is fixed in the closure by a weld.

8. The method for manufacturing a pressure control device as claimed in claim 1, wherein the first cylinder and second cylinder are formed from a suitable synthetic material; the piston with the stem and the valve elements are formed from a suitable synthetic material; the piston with a sealing ring is introduced into the first cylinder until the pressure in the first cylinder starts to raise; the first cylinder is mounted with a closure provided for closing the second cylinder; the valve elements are mounted with the closure and the closure is mounted on the second cylinder.

9. The manufacturing method according to claim 8, wherein the sealing ring is provided with a friction reducing gel.

10. The manufacturing method according to claim 9, wherein the friction reducing gel comprises silicones or graphite oil.

11. The manufacturing method according to claim 8, wherein the first cylinder and the valve elements are welded to the closure, and the closure is welded to the second cylinder.

12. The manufacturing method according to claim 11, wherein the first cylinder and the valve elements are ultrasonic welded to the closure, and the closure is ultrasonic welded to the second cylinder.

* * * * *